US005081469A

United States Patent [19]

Bones

[11] Patent Number: 5,081,469

[45] Date of Patent: Jan. 14, 1992

[54] ENHANCED BANDWIDTH HELICAL ANTENNA

[75] Inventor: Robert B. Bones, Boca Raton, Fla.

[73] Assignee: Sensormatic Electronics Corporation, Deerfield Beach, Fla.

[21] Appl. No.: 74,095

[22] Filed: Jul. 16, 1987

[51] Int. Cl.[5] ..... H01Q 1/360; H01Q 11/80

[52] U.S. Cl. ..... 343/895; 343/745

[58] Field of Search ..... 343/745, 750, 860, 861, 343/895; 340/571, 572

[56] References Cited

U.S. PATENT DOCUMENTS

| | | | |
|---|---|---|---|
| 4,101,899 | 7/1978 | Jones, Jr. et al. | 343/895 |
| 4,427,984 | 1/1984 | Anderson | 343/895 |
| 4,495,503 | 1/1985 | Morman | 343/895 |
| 4,571,595 | 2/1986 | Phillips et al. | 343/745 |
| 4,644,364 | 2/1987 | Parks | 343/861 |
| 4,644,366 | 2/1987 | Scholz | 343/895 |

FOREIGN PATENT DOCUMENTS

| | | | |
|---|---|---|---|
| 0077705 | 5/1984 | Japan | 343/895 |
| 0208904 | 9/1986 | Japan | 343/895 |

*Primary Examiner*—Michael C. Wimer
*Assistant Examiner*—Peter Toby Brown
*Attorney, Agent, or Firm*—Robin, Blecker, Daley & Driscoll

[57] ABSTRACT

An antenna comprises an electrically conductive helical member having a first end and a second opposite end, an elongate substrate supporting such helical member and comprised of electrically insulative material, a ground plane member disposed adjacent the helical member first end, and an impedance matching device adjacent the ground plane member. The impedance-matching device defines an inductive-capacitive circuit, inclusive of inductance constituted by a portion of the initial turn of the helical member and capacitance, one plate of which is constituted by a portion of the initial turn of the helical member. The ground plane member supports the impedance matching device for adjustable positioning circumferentially of the helical member, thereby to effect different inductances in such circuit, and for adjustable positioning radially of the helical member, thereby to effect different capacitances in the circuit.

3 Claims, 5 Drawing Sheets

ENHANCED BANDWIDTH HELICAL ANTENNA

FIELD OF THE INVENTION

This invention relates generally to enhancement of the bandwidth of antennas and pertains more particularly to helical antennas of improved bandwidth.

BACKGROUND OF THE INVENTION

Extended bandwidth, i.e., relatively unchanging performance characteristics with variation in excitation frequency, is often desirable in antennas. Certain antenna configurations have inherently good bandwidth, such as helical antennas.

Helical antennas typically include a cylindrical, electrically insulative substrate upon which a helical, electrically conductive member is disposed. As will be more fully explained below, where the circumference of the helical member is made equal to the wavelength of the antenna excitation frequency, one achieves the so-called "axial" or "beam" mode of radiation, wherein a lobe of desired narrow transverse expanse radiates axially of the helical member and persists, with generally circular polarization, over a relatively wide frequency range.

As a general rule, reported in the literature, from a lower excitation about three-quarters of the helical member circumference in wavelengths to an upper excitation wavelength of about four-thirds of the helical member circumference in wavelength, one achieves such axial mode radiation pattern and radiation persistency characteristic.

It may be said that the helical antenna is inherently impedance-matched over such radiation persistency range, since radiation persistency or uniformity implies that the antenna is impedance-matched. However, as excitation frequency extends beyond such lower and upper wavelength limits, the helical antenna exhibits problematic performance, which likewise may be attributed to it being impedance-mismatched.

Certain art-recognized parameters of helical antennas are shown in FIGS. 1 through 4. Referring thereto, a known helical antenna 10 includes a generally cylindrical and electrically insulative substrate 12 upon which is disposed a helical, electrically conductive member 14, having a lower starting end 16 and an upper end 18, such ends being generally circumferentially coincident. A ground plane member 20 of electrically conductive material is adjacent helical member end 16. The circumference C of helical member 14, of course, is equal to the product of pi (3.1416) times the diameter D of member 14. A spacing S exists between ends of each individual turn of member 14. As is shown in the geometric diagram of FIG. 4, the length L of each turn, in rectilinear dimension, in unwound condition, is the hypotenuse of a triangle having mutually orthogonal sides C and S, giving rise to definition of a pitch angle A. The foregoing axial mode persistency and broadband characteristic applies where C is generally equal to the excitation wavelength and the pitch angle is relatively small, for example, from about ten to sixteen degrees.

While the art generally recognizes a variety of impedance matching elements, typically in the form of lumped reactance elements such as coils and capacitors, complexity and cost attends these impedance matching schemes and they are generally operative over only a limited extended frequency range.

In addition to the need for improved and simplified schemes for impedance matching to achieve enchanced bandwidth, the art looks in various instances to performance uniformity among separate antennas performing interrelated functions, such as in transmit-receive systems. For example, well-known electronic article surveillance (EAS) systems have mass produced antennas respectively for radiating energy into a controlled or surveillance zone to impinge upon tags affixed to articles and for receiving energy returned from tags for alarm output indication under certain conditions. Since uniformity in transmission and reception is desired, antenna characteristic sameness with change in frequency is of significance.

SUMMARY OF THE INVENTION

The present invention has as its primary object the provision of antennas of enhanced bandwidth.

A more particular object of the invention is the provision of helical antennas exhibiting improved performance characteristics.

A specific object of the invention is to provide a helical antenna of enhanced axial mode radiation character and of relatively simple construction.

A still further object of the invention is the provision of pluralities of antennas having capability for adjustment to provide characteristic uniformity as a group.

In attaining the foregoing and other objects, the invention provides, in structural aspect, an antenna comprising an electrically conductive helical member having a first end and a second opposite end, an elongate substrate supporting such helical member and comprised of electrically insulative material, a ground plane member disposed adjacent the helical member first end and an electrically conductive element disposed in spaced juxtaposition with the helical member radially thereof at a location spaced circumferentially of the helical member from the first end thereof. The electrically conductive element extends in part axially with the helical member preferably to an extent not in excess of the initial turn thereof, and extends in further part contiguously with the ground plane member. The ground plane member supports the electrically conductive element and may provide for variable positioning thereof radially and/or circumferentially of the helical member.

In functional aspect, the invention is considered to provide an antenna comprising an electrically conductive helical member having a first end and a second opposite end, an elongate substrate supporting such helical member and comprised of electrically insulative material, a ground plane member disposed adjacent the helical member first end an impedance matching device adjacent the ground plane member. The impedance-matching device defines an inductive-capacitive circuit, inclusive of inductance constituted by a portion of the initial turn of the helical member and capacitance, one plate of which is constituted by a portion of the initial turn of the helical member. The ground plane member supports the impedance matching device for adjustable positioning circumferentially of the helical member, thereby to effect different inductances in such circuit, and for adjustable positioning radially of the helical member, thereby to effect different capacitances in the circuit.

In a plural antenna embodiment, a common ground plane supports first and second antennas, each being equipped with an impedance matching device of the described type.

The invention further provides particularly for the improvement of EAS systems through inclusion therein of the antenna herein.

The foregoing and other objects and features of the invention will be further understood from the following detailed description of preferred embodiments of the invention and from the drawings wherein like reference numerals identify like part throughout.

DESCRIPTION OF PREFERRED EMBODIMENTS AND PRACTICES

Figure 6:
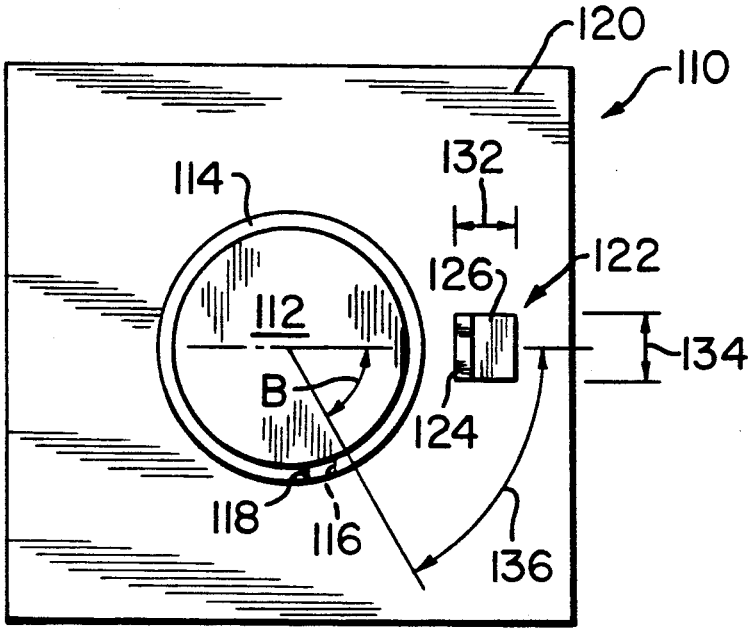
FIG. 6 is a plan view of the FIG. 5 antenna.
Figure 5:
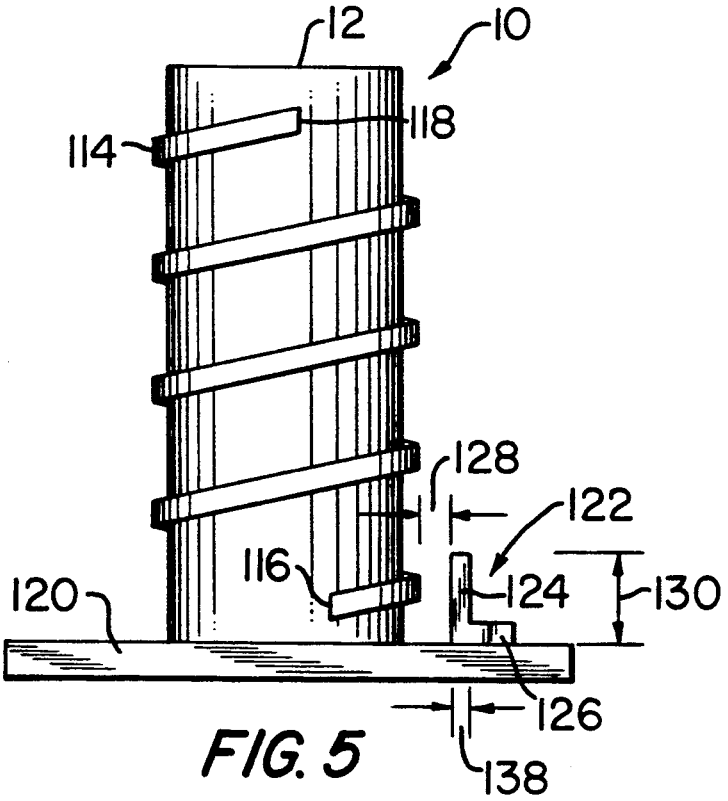
FIG. 5 is a front elevational view of a first embodiment of a helical antenna constructed in accordance with the invention.

Referring to FIGS. 5 and 6, helical antenna 110 includes a generally cylindrical and electrically insulative substrate 112 upon which is disposed a helical, electrically conductive member 114, having a lower starting end 116 and an upper completing end 118. Ends 116 and 118 are perimetrically or circumferentially generally coincident, thus providing antenna 110 with an integral number of turns. A ground plane member 120 of electrically conductive material is adjacent helical member end 116.

In EAS system usage of antenna 110, axial mode radiation is desirable. As above noted, for a given excitation frequency and axial mode radiation, the circumference of member 114 is made equal in wavelength (the inverse of frequency) to that of the excitation frequency. In certain EAS applications, as for example, in systems commercially available from the assignee hereof, antenna excitation is over a frequency sweep. Accordingly, in these applications, the center frequency of the sweep range is selected to be such given frequency.

While the inherent broad bandwidth of the helical types of antennas allows for performance consistency over a large extent of a sweep range, at ends of the sweep range, performance of such antenna can deteriorate by phenomena believed to be associated with impedance mismatching at the range end frequencies.

In accordance with the present invention, antenna 110 includes an electrically conductive element 122, having an upstanding or first portion 124, spacedly juxtaposed with helical member 114, and a horizontal or second portion 126 juxtaposed with ground plane 120 and preferably electrically continuous therewith. Spacing between portion 124 and helical member 114 is indicated at 128. The height of portion 124 is shown at 130. The horizontal extent of portion 126 is indicated at 132 and the depth of portion 126 is shown at 134. Arc 136 distends an angle B, commencing at end portion 116 of helical member 114 and ending at the center of element 122.

It is found, in the invention, that improved performance of helical antennas at frequencies otherwise having deteriorated performance is achieved by the presence of element 122. Placement and dimensions of element 122 are empirically determined, an example being given below. While full analytical basis is not known for this phenomenon, as is customary in this art, it is believed that the circumferential spacing of element 122 from the starting end 116 of helical member 114, as by angle B, provides an impedance matching inductance, i.e., a portion of the initial turn of helical member 114. Further, spacing 128 is believed to define, with facing extent of helical member 114 in such first turn, and with portion 124 of element 122, an impedance matching capacitor in effective circuit relation with such inductance. The plates of such capacitor are portion 124 of element 122 and extent of helical member 114 in facing relation with portion 124. This inductance and capacitor thus are believe to comprise an adjunct impedance matching network which is coupled to ground plane 120 by portion 126 of element 122.

Figure 3:
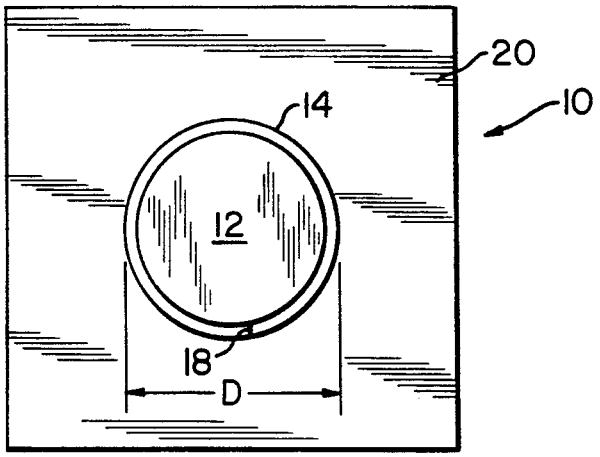
FIG. 3 (PRIOR ART)
FIG. 3 is a right side elevational view of the FIG. 1 antenna.
Figure 1:
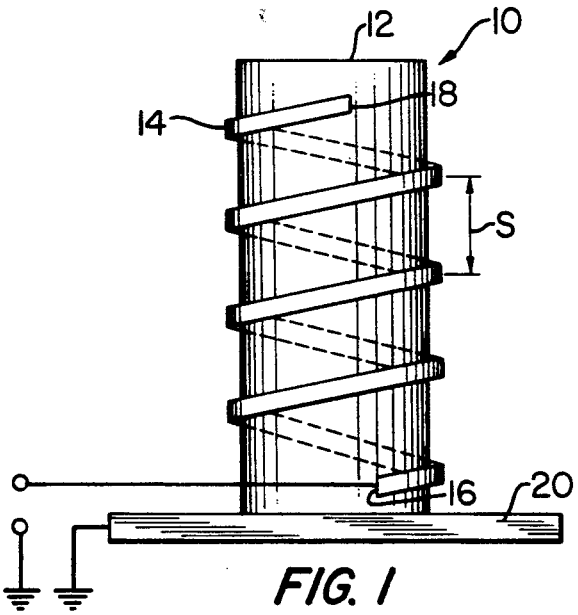
FIG. 1 (PRIOR ART)
FIG. 1 is a front elevational view of a helical antenna as is known in the prior art.
Figure 2:
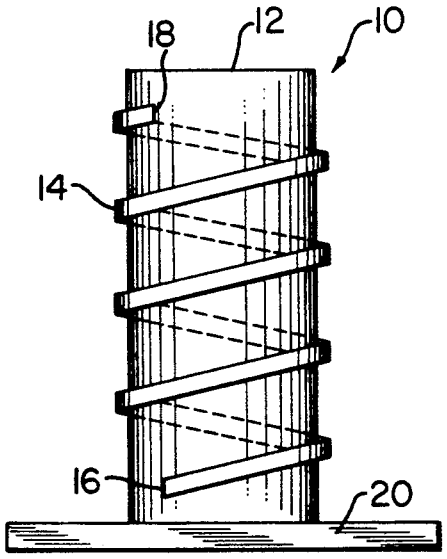
FIG. 2 (PRIOR ART)
FIG. 2 is a plan view of the FIG. 1 antenna.
Figure 4:
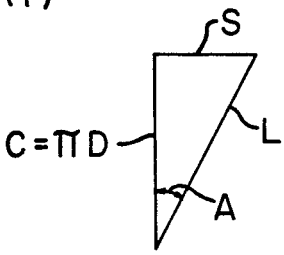
FIG. 4 (PRIOR ART)
FIG. 4 is a geometric showing of the interrelationship among several parameters of helical antennas.
Figure 7:
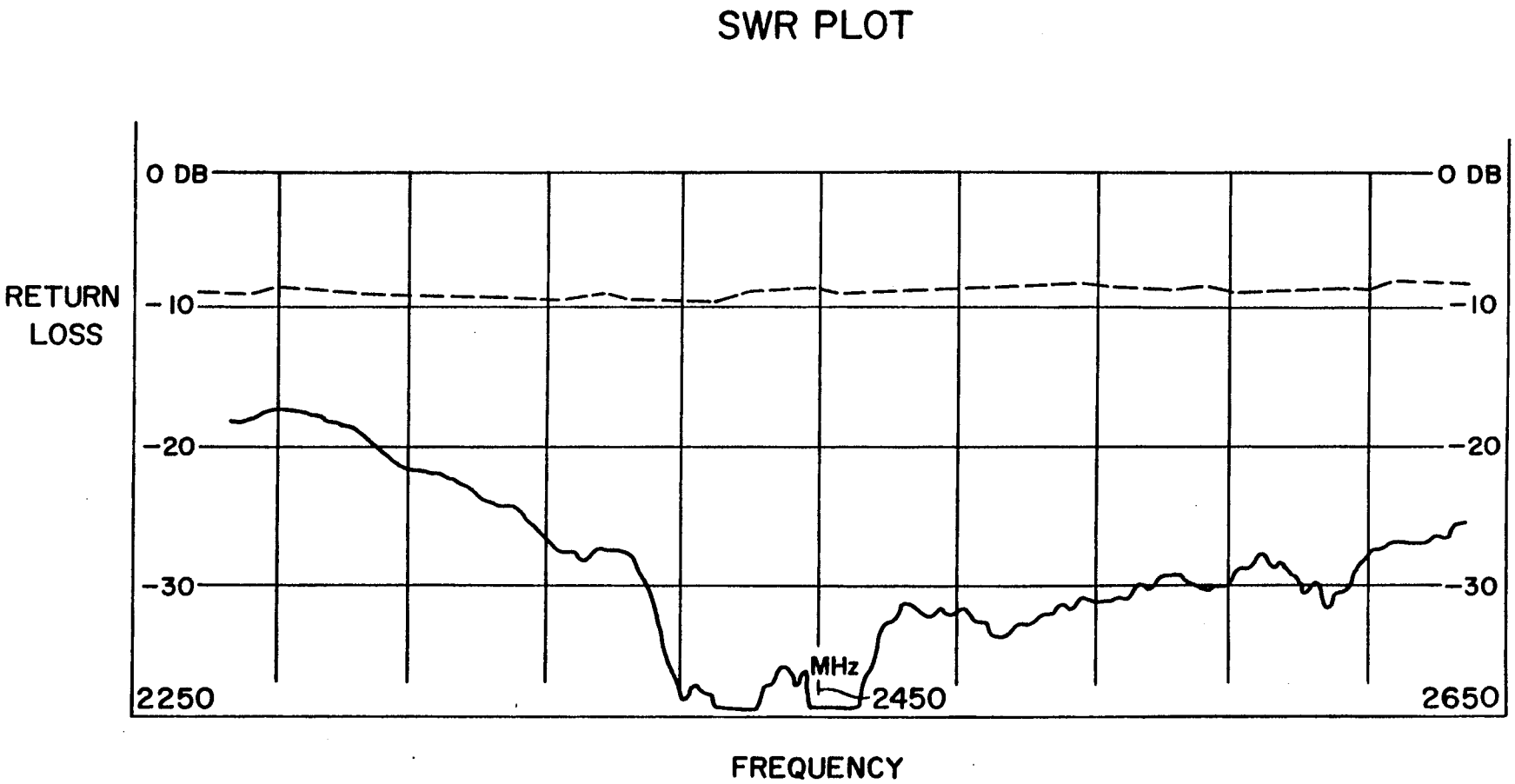
FIG. 7 is a plot showing, in dotted lines, the standing wave ratio (SWR) of an antenna of FIG. 1 type and, in solid lines, the SWR of an antenna of FIG. 5 type.

By way of a specific example of antenna 114, helical member 114 is implemented by an AWG #8 silver plated copper wire wound into four turns over an axial length of substrate 112 of 3.38 inches. The pitch angle (A, FIG. 4) is 10.1 degrees. Dimensions are as follows: 128-35 mils; 130-375 mils; 132-1.00 inch; 134-375 mils; angle B - 30.0 degrees; and 138-62 mils. The SWR plot for this antenna configuration is seen in the solid lines of FIG. 7. The SWR plot for this antenna, with element 122 not present, is seen in the dotted lines of FIG. 7. As is seen, improved performance is seen at the upper and lower ends of the sweep frequency range. Thus, an average db (decibel) spread over the frequency range of from 2250 MHz tp 2650 MHz os 31.2 in the solid line FIG. 7 plot, whereas the average db spread in the dotted line plot for the same frequency range is 8.3.

Figure 9:
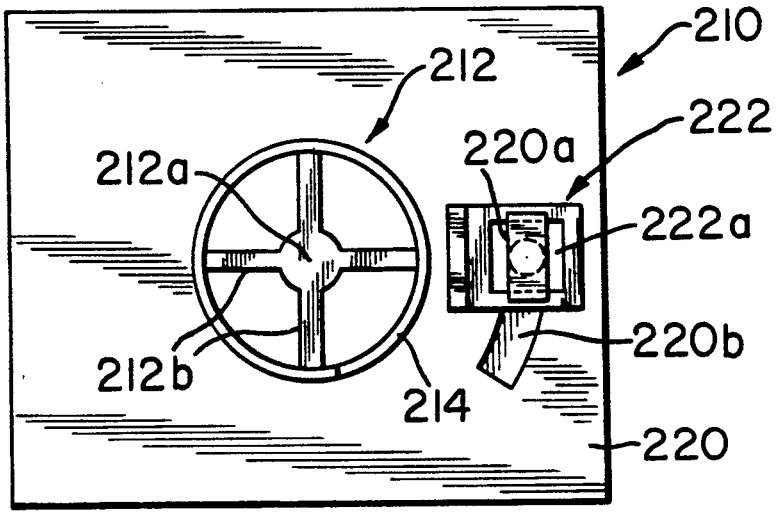
FIG. 9 is a plan view of the FIG. 8 antenna.
Figure 8:
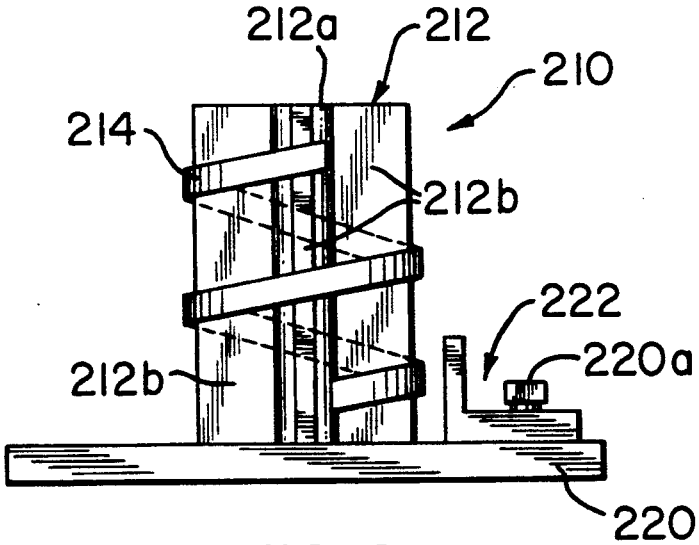
FIG. 8 is a front elevational view of a second embodiment of a helical antenna constructed in accordance with the invention.

Turning now to the second embodiment of the invention in FIGS. 8 and 9, antenna 210 has substrate 212 having a hub **212*a* and arms 212*b* extending radially outwardly of hub 212*a* and supporting helically wound wire 214. Conductive element 222 has slot 222*a* and ground plane 220 has a threaded opening for receipt of keeper 220*a*. By this structure, it will be seen that element 222 may be readily variably positioned radially of hub 212*a*. The adjunct impedance matching network of inductance and capacitance may thus have variable capacitance for ready and simple adjustment. As will be appreciated, ground plane 220 may alternatively or cumulatively be equipped with a circumferential slot 220*b* extending from its threaded opening receiving keeper 222*a*, whereby element 222 may alternatively or cumulatively be adjustably situated circumferentially of helical member 214**.

Figure 11:
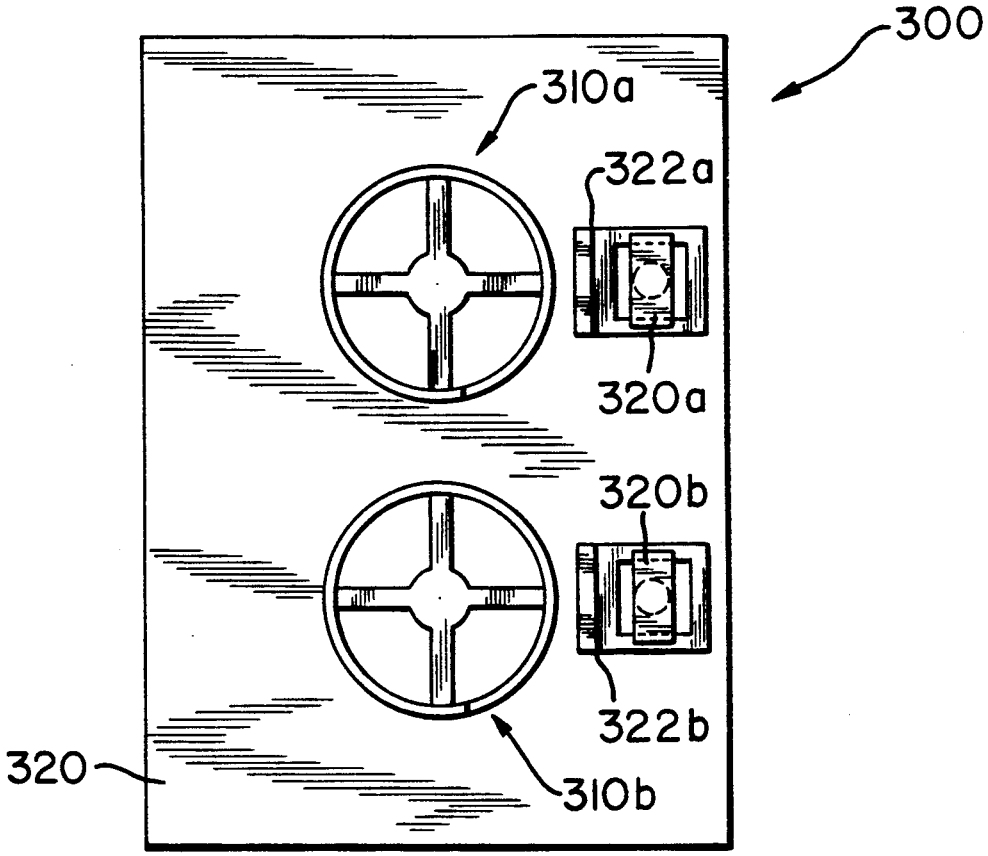
FIG. 11 is a plan view of the FIG. 10 antenna arrangement.
Figure 10:
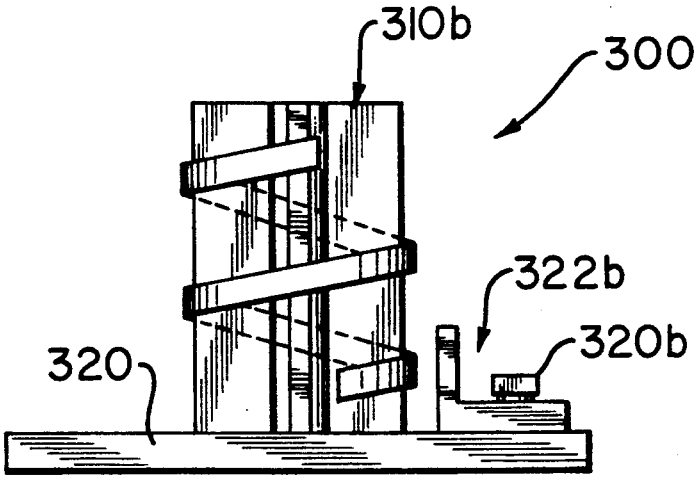
FIG. 10 is a front elevational view of a plural helical antenna arrangement in accordance with the invention.

In the further embodiment of FIGS. 10 and 11, an EAS system antenna arrangement 300 includes antennas **310*a* and 310*b*. Both antennas are supported by ground plane 320, which defines latching openings for receipt of respective keepers 320*a* and 320*b*. Impedance matching elements 322*a* and 322*b* are slotted as above discussed and may be situated in adjustable radial or circumferential positions with respect to their associated helical members. As will be appreciated, antenna arrangement 300** may be arranged with ground plane generally parallel to a passageway or like zone to be controlled, i.e., a surveillance zone of an EAS system. Incorporating reference is made to Welsh et al. U.S. Pat. No. 4,063,229, entitled "Article Surveillance", which issued on Dec. 13, 1977 and is commonly-assigned herewith.

Various changes may be introduced in the foregoing particularly described embodiments and modifications may be made to the described practices without departing from the invention. Accordingly, it should be understood that the discussion of preferred embodiments depicted in the drawings and methods for implementing the invention are intended in an illustrative, and not in a limiting sense. The true spirit and scope of the invention is set forth in the appended claims.

What is claimed is:

1. A wideband helical antenna, comprising:

(a) an electrically conductive helical member having a first end and a second opposite end;

(b) an elongate substrate supporting such helical member and comprised of electrically insulative material;

(c) ground plane means for disposition adjacent said helical member first end and defining a detent for receipt of a keeper; and (d) electrically conductive means disposed in spaced juxtaposition with said helical member adjacent said first end thereof and having a slot therein for receipt of said keeper, whereby said electrically conductive means may be variably positioned radially of said helical member.

2. The invention claimed in claim 1 wherein said ground plane means detent comprises a slot extending circumferentially of said helical member, whereby said electrically conductive means further may be variably positioned circumferentially of said helical member.

3. The invention claimed in claim 1 wherein said electrically conductive means comprises a body having a first portion extending axially with said helical member and a second portion extending radially of said helical member, said second portion defining said slot.

* * * * *